US008659435B2

(12) United States Patent
McKinney

(10) Patent No.: US 8,659,435 B2
(45) Date of Patent: Feb. 25, 2014

(54) WATERPROOF OPTICALLY-SENSING FIBERLESS-OPTICALLY-COMMUNICATING VITALITY MONITORING AND ALARMING SYSTEM, PARTICULARLY FOR SWIMMERS AND INFANTS

(76) Inventor: George Anthony McKinney, San Diego, CA (US)

( * ) Notice: Subject to any disclaimer, the term of this patent is extended or adjusted under 35 U.S.C. 154(b) by 261 days.

(21) Appl. No.: 12/798,401

(22) Filed: Apr. 2, 2010

(65) Prior Publication Data

US 2011/0241887 A1 Oct. 6, 2011

(51) Int. Cl.
*G08B 23/00* (2006.01)

(52) U.S. Cl.
USPC ..... 340/573.6; 340/573.1; 340/850; 340/815.4

(58) Field of Classification Search
USPC ..... 340/573.6
See application file for complete search history.

(56) References Cited

U.S. PATENT DOCUMENTS 6,539,400 B1 * 3/2003 Bloomfield et al. ..... 1/1
6,788,197 B1 * 9/2004 Thuillard et al. ..... 340/522
7,415,212 B2 * 8/2008 Matsushita et al. ..... 398/140
2007/0222970 A1 * 9/2007 Haan et al. ..... 356/4.08
2008/0266118 A1 * 10/2008 Pierson et al. ..... 340/573.6
2009/0263581 A1 10/2009 Martin, III et al.
2009/0263641 A1 10/2009 Martin, III et al.
2009/0295566 A1 * 12/2009 Weintraub ..... 340/539.11
2010/0013642 A1 * 1/2010 Watson et al. ..... 340/573.1
2010/0056878 A1 * 3/2010 Partin et al. ..... 600/301
2010/0324387 A1 * 12/2010 Moon et al. ..... 600/324
2011/0309755 A1 * 12/2011 Wirth et al. ..... 315/151

* cited by examiner

*Primary Examiner* — George Bugg
*Assistant Examiner* — Anthony D Afrifa-Kyei
(74) *Attorney, Agent, or Firm* — Knobbe, Martens, Olson & Bear, LLP

(57) ABSTRACT

The vitality of a swimmer, or of a child, is monitored by a periodically-activated micro-powered solar- and battery-powered waterproof microminiaturized (1) optical sensor of heart activity, electrically connected to (2) a microprocessor monitor, for jointly determining when a person's heart activity has stopped. When and if required, the microprocessor causes to be transmitted, through water a blue-green light alarm signal. When this optical alarm signal is received by an optical receiver/alarm in air, the receiver/alarm produces an audio and/or visual alarm that, when sensed by a human, potentially timely permits rescue and resuscitation of the swimmer, or the child. The battery-and-solar-powered monitor that forms the core of the vitality monitoring system is roughly ten times faster and more capable, with but one-tenth the power consumption, than previous real-time biological monitoring systems.

25 Claims, 6 Drawing Sheets

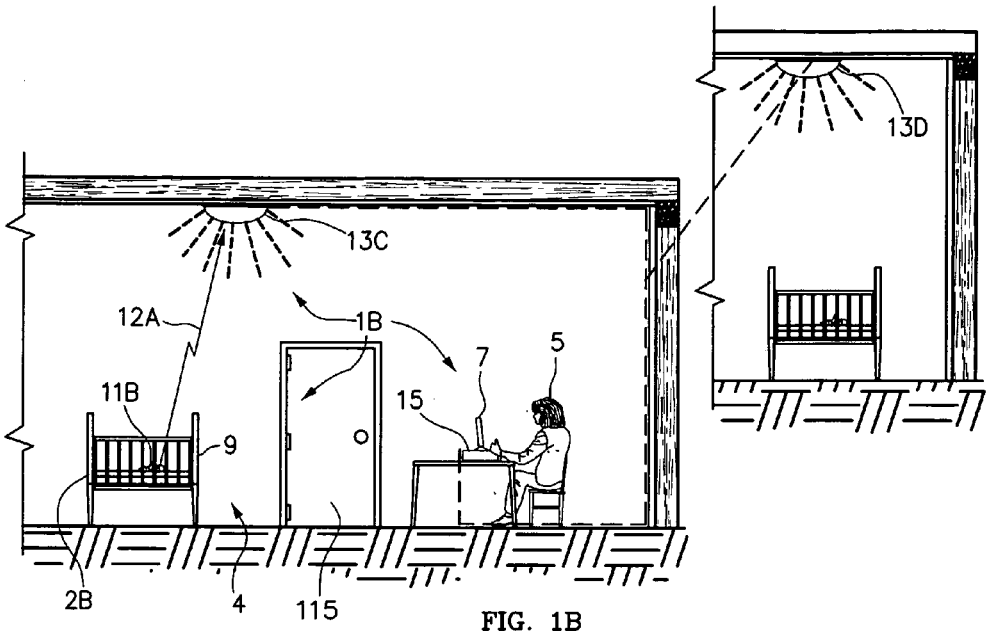
FIG. 1B
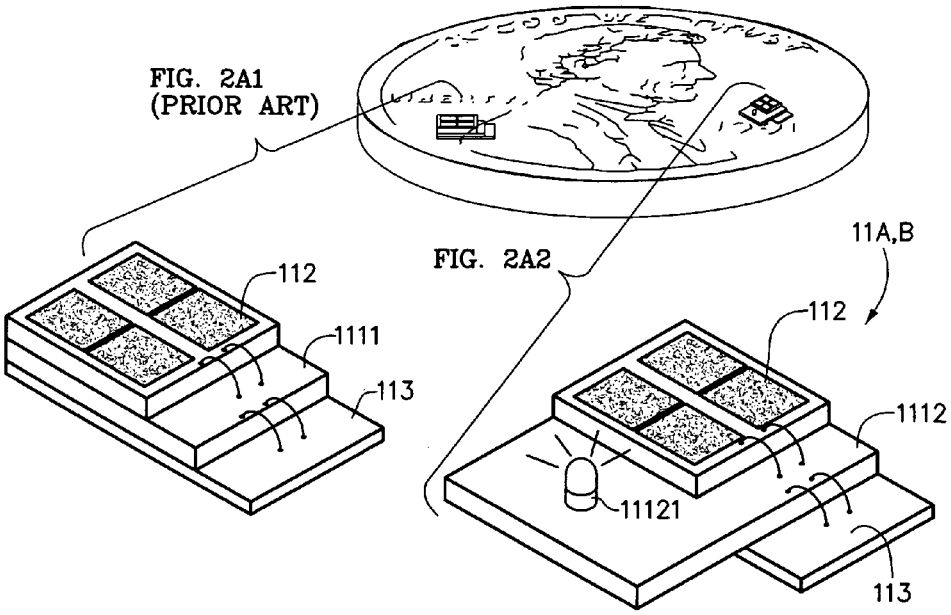

HEART CHECK SIGNAL
CLK
Vdd
GND
MODULATION XOR
LED DRIVER
1112
TX
LED
11121
12A,B
WATER

PHOTODIODE
dsPIC
RX
13A,13B
DEMODULATED SIGNAL
GND
Vdd
VDD
C1
C2
C3
P1
Vdd
U4A
U1B
U1C
U1D
U1E
U1F
U2B
U2C
U2D
U2E
U2F
U3B
U3C
U3D
U3E
U3F
P2

11121
12A,B

WATERPROOF OPTICALLY-SENSING FIBERLESS-OPTICALLY-COMMUNICATING VITALITY MONITORING AND ALARMING SYSTEM, PARTICULARLY FOR SWIMMERS AND INFANTS

BACKGROUND OF THE INVENTION

1. Field of the Invention

The present invention generally concerns personal safety systems and methods, and more particularly, systems and methods for monitoring a person or persons and timely identifying a person experiencing an emergency physical condition. In particular, the system and method of the present invention concerns detecting and alarming a swimmer that may be in initial stages of drowning, or any person having an asphyxia event such as baby in a nursery potentially stricken with Sudden Infant Death Syndrome.

The personal and site safety system and methods of the present invention—directed to providing detection of a possible drowning person or person experiencing asphyxia—will be seen to use heart rate or pulse rate monitoring, or the monitoring of other physiological systems that indicate a person in distress or drowning, and thus concerns these functions also. The preferred system may in particular include (1) a cardiac monitoring system and alarm indicator or transmitter system worn by a person; with (2) a variety of other functions optionally provided, such as location monitoring, sound monitoring, data recording, and other desired functions.

Finally, the systems and methods of the present invention will be seen to concern an alarm receiver system, located relative to the person wearing the monitoring system (such as relative to the person's location in a body of water), wherein an alarm indication is detected and communicated to emergency responder or to safety personnel, or to others.

2. Background of the Invention

Unlike the systems and methods of the prior art, the system and method of the present invention will be seen to possess certain unique attributes primarily, including as are directed to ease of use and maintenance.

In particular, the system and method of the present invention will be seen to preferably incorporate (1) wearable miniaturized heartbeat/cardiac sensor units are both compact and easily donned and worn (upon the ear lobes, or the web of the hand); (2) portable/wearable system elements that are reliable and require but minimal maintenance in use, being that the sole element that is preferably both portable and wearable incorporates a battery that is recharged by a solar power charger that is integral to the same element; (3) heartbeat/cardiac sensor units each of which has, nonetheless to being of sub-coin size, a complete microprocessor system that can—should energy resources support and be desired to be so devoted—effect such recording and diagnosis of heartbeat and/or cardiac function that might be deemed to be more typical of a digitalized recording electrocardiogram than a mere portable detector of heartbeat so as to determine vitality, (4) a first major systems signal path (through the ear lobe, or the web of the hand) that is optical, and thus reliably functional at low power nonetheless to being potentially fully or partially immersed, (5) a second major systems communication path (between the wearable miniaturized heartbeat/cardiac sensor unit and an alarm that is situated in air) that is also optical, and thus again reliably functional at low power nonetheless to being potentially fully or partially immersed, and (6) an ability to use, and optionally to discriminate among, many heartbeat sensors as are simultaneously worn by many persons in concert, such as during the simultaneously monitoring of hundreds of persons in a swimming pool.

2.1 The Problem of Drowning While Swimming, Including in Supervised Swimming Pools As related in U.S. patent application No. 20080266118 to Nicholas J. Pierson, et al., "[t]he dangers of accidental drowning are recognized, with parents keeping their children away from the water unless under constant supervision, and attempting to teach their children to swim as early as possible. Yet, drowning is the second leading cause of accidental death in children, and drowning related injuries are the fifth most likely cause of accidental death in the United States presently. Drowning accidents can occur in all age groups, but particularly is of concern with children between the ages of 1 and 4 years old and in teenage children, and many times can be caused by non-supervision, horseplay, and daredevil stunts. Other factors, such as alcohol or other impairment can also lead to drowning accidents. Near-drowning accidents are described as survival after suffocation caused by submersion in a liquid. Drowning accidents are described as events in which a victim dies within 24 hours after having been submerged in a liquid. Generally, when a person becomes submerged, they hold their breath until they cannot do so any longer, with the time for this to occur being dependent somewhat on that person. If the person is still conscious, they may try to gasp for air, aspirating water into the lungs. For many facilities, such as lakes, pools, beaches or the like, lifeguards are hired to attempt to prevent injuries or drownings, requiring significant expense and expertise. Even with lifeguards on duty, drownings still occur each year.

"Although there have been attempts to prevent drowning in pools or the like, particularly where there may be no lifeguard on duty, such attempts have not gained acceptance, as they have been expensive and/or ineffective for many applications. For example, anti-drowning systems have included devices carried by a non-swimmer that signal a receiver upon contact with the water. Although assisting where a user is attempting to keep a person out of the water, such as a small child, such devices are limited and don't assist while a person is swimming. Other systems have been developed for pools which use an array of cameras and sophisticated software to attempt to detect an unmoving person under the water, such systems being expensive and prone to difficulties in use.

"It would be desirable to more effectively monitor people for water safety to facilitate preventing drowning or other cases of asphyxiation accidents, with a simple but effective system to accurately and quickly identify a possible drowning person or person suffering an asphyxia event, and provide notification of an emergency condition. The identification of an asphyxia event, such as a drowning person, as quickly as possible is important, as death can occur in just a few minutes. A simple, reliable, compact and economical device and methods are needed. It would also be desirable to be able to detect other emergency situations, such as choking, apneic events or the like."

2.2 The Problem of Sudden Infant Death Syndrome ("SIDS")

In the entry "Sudden infant death syndrome" appearing in Wikipedia, the free encyclopedia of the Internet, circa 2010, it is explained that "sudden infant death syndrome (SIDS) or crib death is a syndrome marked by the sudden death of an infant that is unexpected by history and remains unexplained after a thorough forensic autopsy and a detailed death scene investigation.

"SIDS was responsible for 0.543 deaths per 1,000 live births in the U.S. in 2005. It is responsible for far fewer deaths than congenital disorders and disorders related to short gestation, though it is the leading cause of death in healthy infants after one month of age.

"SIDS deaths in the U.S. decreased from 4,895 in 1992 to 2,247 in 2004. But, during a similar time period, 1989 to 2004, SIDS being listed as the cause of death for sudden infant death (SID) decreased from 80% to 55%. According to Dr. John Kattwinkel, chairman of the Center for Disease Control (CDC) Special Task Force on SIDS "A lot of us are concerned that the rate (of SIDS) isn't decreasing significantly, but that a lot of it is just code shifting" . . . .

2.3 A New Millimeter-Scale Microprocessor and Sensor System

In one of its embodiments the present invention will be seen use the battery adaptation—and optionally also the light, or solar, power—developed and reported as a "Millimeter-scale, energy-harvesting sensor system" about Feb. 8, 2010.

This low-power sensor system, developed at the University of Michigan, is about 1,000 times smaller than comparable commercial counterparts. It is directed to enabling new biomedical implants (which is not its use in the present invention). The 9-cubic millimeter solar-powered sensor system is the smallest that can harvest energy from its surroundings to operate nearly perpetually.

The U-M system's processor, solar cells, and battery are all contained in its tiny frame, which measures 2.5 by 3.5 by 1 millimeters. It is 1,000 times smaller than comparable commercial counterparts.

The system could enable new biomedical implants as well as home-, building- and bridge-monitoring devices. It could vastly improve the efficiency and cost of current environmental sensor networks designed to detect movement or track air and water quality.

With an industry-standard ARM Cortex-M3 processor, the system contains the lowest-powered commercial-class microcontroller. It uses about 2,000 times less power in sleep mode than its most energy-efficient counterpart on the market today.

The engineers say successful use of an ARM processor—the industry's most popular 32-bit processor architecture—is an important step toward commercial adoption of this technology.

Greg Chen, a computer science and engineering doctoral student, will present the research February 9 at the International Solid-State Circuits Conference in San Francisco.

"Our system can run nearly perpetually if periodically exposed to reasonable lighting conditions, even indoors," said David Blaauw, an electrical and computer engineering professor. "Its only limiting factor is battery wear-out, but the battery would last many years."

"The ARM Cortex-M3 processor has been widely adopted throughout the microcontroller industry for its low-power, energy efficient features such as deep sleep mode and Wake-Up Interrupt Controller, which enables the core to be placed in ultra-low leakage mode, returning to fully active mode almost instantaneously," said Eric Schorn, vice president, marketing, processor division, ARM. "This implementation of the processor exploits all of those features to the maximum to achieve an ultra-low-power operation."

The sensor spends most of its time in sleep mode, waking briefly every few minutes to take measurements. Its total average power consumption is less than 1 nanowatt. A nanowatt is one-billionth of a watt. (This property—with the waking time interval suitably adjusted—will be seen to be employed in the present invention.)

The developers say the key innovation is their method for managing power. The processor only needs about half of a volt to operate, but its low-voltage, thin-film Cymbet battery puts out close to 4 volts. The voltage, which is essentially the pressure of the electric current, must be reduced for the system to function most efficiently. The present invention will be seen to use a much, much larger and conventional "watch-type" battery, but the adaptation of the micro-powered circuitry of the University of Michigan to any miniature battery is still important to the present invention.

"If we used traditional methods, the voltage conversion process would have consumed many times more power than the processor itself uses," said Dennis Sylvester, an associate professor in electrical and computer engineering.

One way the U-M engineers made the voltage conversion more efficient is by slowing the power management unit's clock when the processor's load is light.

"We skip beats if we determine the voltage is sufficiently stable," Sylvester said.

The designers are working with doctors on potential medical applications. The system could enable less-invasive ways to monitor pressure changes in the eyes, brain, and in tumors in patients with glaucoma, head trauma, or cancer. In the body, the sensor could conceivably harvest energy from movement or heat, rather than light, the engineers say.

The inventors are commercializing the technology through a company led by Scott Hanson, a research fellow in the Department of Electrical Engineering and Computer Science.

The paper is entitled "Millimeter-Scale Nearly Perpetual Sensor System with Stacked Battery and Solar Cells." This research is funded by the National Science Foundation, the Defense Advanced Research Projects Agency, the National Institute of Standards and Technology, the Focus Center Research Program and ARM.

2.4 A New Waterproofing Process For Electronics Equipments

The methods of U.S. patent applications No. 20090263641 for a METHOD AND APPARATUS TO COAT OBJECTS WITH PARYLENE, and No. 220090263581 for a METHOD AND APPARATUS TO COAT OBJECTS WITH PARYLENE AND BORON NITRIDE, garnered some notoriety as publicly demonstrated during 2009-2010.

Doing business as "Golden Shellback", the web site of the enterprise reports that the inventions derive from a dilemma faced by Sid Martin, Director of Technology at Northeast Maritime Institute. "He had been hired to spearhead a project bringing the latest technology to the field of Maritime Security and test it in the field. Martin was the perfect candidate for this job. Prior to working at NMI he was a member of the project team responsible for the wheel bearings on the Mars Lander and in doing so became familiar with the obstacles faced in developing products for use in harsh environments. But the project was nearing completion and he needed to find new ways to use his experience at the institute.

"Before developing Aerospace technology Martin worked for years in the manufacturing of semiconductors and during this time he gained both knowledge and experience coating objects at a molecular scale. With the sole directive of realizing the Institute's mission to "honor the mariner" Sid diverted his focus from maritime security to a long stirring idea; Waterproofing Electronics.

"With the backing of NMI President Eric Dawicki he began work on techniques he learned during the time he worked in the semiconductor industry, applied coatings to surfaces at the molecular level. Up to this point marine electronics were separated from the corrosive and conductive properties of salt water with the use of protective shells. A waterproof radio for example, combines a protective shell with plastic coating and gaskets to keep water away from sensitive electrical components. This works fairly well provided you maintain the watertight integrity of the unit but it's expensive to manufacture and maintain not to mention the extra weight and bulk it adds to the device itself. Damage the shell or service the components in harsh conditions and that protection is useless.

"Martin's idea was different. By merging his experience in harsh weather design with his knowledge of semiconductors he developed a new coating that provides direct protection to both internal and external components of a device regardless of size. The process itself is a closely guarded secret but results in a ultra thin yet durable protection at the molecular level."

This coating can be realized in accordance with the materials and processes of the two patent applications and, being optically transparent (such as permits the display screens of the coated electronic equipments to be read), is preferred as the waterproofing material and method for use in the system of the present invention.

2.5 A Previous Patent Application

U.S. patent application No. 20080266118 to Nicholas J. Pierson; et al., for "Personal emergency condition detection and safety systems and methods" concerns drowning or asphyxiation prevention system and methods for facilitating drowning prevention of swimmers in bodies of water, such as pools, lakes or the like. The drowning prevention safety system comprises a wearable article worn by a swimmer, an alarm indicator for transmitting an alarm condition. The system may further include an alarm receiving system for receiving the alarm signal from the alarm transmitting device. A patch type portion may be adhesively applied to the skin of a user to monitor the electrical activity of the heart and generate heart rate information that is communicated to a separate wearable device, such as a wrist worn device.

2.6 Approaches to, and Fundamentals of, Vitality Monitoring Systems

Any vitality monitoring system may further comprise a locating devices, such as those operating by proximity detection, GPS location, of still other techniques for location surveillance or distance detection. A device may also include a panic button for the user to trigger the indicator and/or alert a surveillance or alarm detection system, which may also be used to turn off the alarm indication if necessary.

Any system may also include other features, such as multiple physiological function detectors and/or multiple alarm indicators, such as audible, visual or other indicators. Alarm detection may be provided by various systems, such as one or more sound receivers, visual alarm detectors, or other systems. Emergency conditions may also be detectable from audible sounds of a person that may be in distress or carbon dioxide shock. A visual alarm indicator can be for example a bright light, inflatable balloon type device, colored fluid ejection or the like, may be provided.

Other systems to prevent impaired people from entering the water, such as an alcohol monitor or measurement device may be provided. The monitoring system may be small, compact, durable, and easily worn by a person while swimming, or otherwise making it easily usable.

In consideration of these many possibilities, the system and method of the present invention are directed to certain things that are fundamental to any swimmer or infant monitoring system. Foremost among these things are that (1) the system must be, at least in part, both user wearable and waterproof, (2) communication between system components that are immersed and alarms that sound in air should be reliable, and (3) system components should be both affordable in initial cost, and should incur low life cycle costs of operation.

The present invention will immediately be next seen to have arguably dealt in an elegant manner with each of these three fundamental requirements.

2.6 Shellback

The present invention will be seen to employ, in certain embodiments, components that are waterproofed by a transparent coating. This coating is most preferably called a one called "Shellback", which is a new invention just come onto the market circa 2010. The coating was first publically shown to high acclaim in that it permits electronic devices such as cell phones to be satisfactorily waterproofed, such as will thereafter protect the same from rain and from being immersed in toilet water. The waterproofing is realized without interference with operation of the pushbutton controls, the view screen, the connections, the speaker, etc. of the cell phone. The waterproofing is strikingly demonstrated by immersion of a treated coated cell phone in water, where it continues to "operate", although the waterproofing of the operating phone clearly does not change (1) the attenuation of radio frequency signals, nor (2) the limitations of sound transmission in water, so that the "Shellback" waterproofing of the cell phone will be understood not to render the cell phone usable under water, but simply to protect the cell phone and its circuitry, pushbutton key switches, display screen, etc., from water damage. (The circuitry of the present invention will be seen to be functionally operative under water.)

This new waterproof coating is described in U.S. patent application publication number 20090263641 for a METHOD AND APPARATUS TO COAT OBJECTS WITH PARYLENE, and also in publication number 220090263581 for a METHOD AND APPARATUS TO COAT OBJECTS WITH PARYLENE AND BORON NITRIDE, both to Sidney Edward Martin, III; et al. The applications describe a method of coating preferred for use with at least the underwater components of the preferred embodiment of the invention of the present application.

In the patent-applied-for method of Martin, III; et al., Silquest is applied to an object as a vapor. A related method coats objects with Parylene and Silquest. This prior art describes a vapor deposition apparatus with multi-temperature zone furnaces that is useful for applying a Parylene coating to objects. The application further provides objects coated with Silquest and polymers, including Parylene, where the objects are incompatible with immersion in water.

SUMMARY OF THE INVENTION

The present invention contemplates a real-time vitality monitoring and alarming system, particularly for swimmers and infants. The system can be employed for a large number of persons in parallel, and at the same time—as in a public swimming pool, or a hospital's nursery—with the flashing and sounding of a central alarm if the heart of any monitored person is sensed to have stopped for more than about twenty seconds. The alarm produced by the system of the present invention is thus timely to enable potential revival of the person, which is desirably commenced within two minutes.

The system includes (1) a waterproof sensor and monitor of vitality worn by a person, and communicating by line-of-sight optical signal to (2) one or more detectors both submerged and in air which detectors will cause (3) an alarm to visibly and audibly sound.

The (1) vitality sensor and monitor is waterproof, micro-minaturized and micro-powered, containing a microprocessor and memory that is powered by a micro-miniature battery that is recharged by a miro-miniaturized solar cell. The sensor and monitor preferably attaches to the ear lobe or web of the hand, or, optionally, two identical such sensors attach one to each ear lobe or hand, in order to sense the vitality, and heart beat, of the wearer by such variations in blood flow in the micro-capillaries of these regions as do effect optical transmission. The blood flow, and heart function, is sensed by shining a beam of infrared light through these micro-capillaries of the ear lobe, or hand web, from (1a1) an optical emitter, preferably a red LED, to (1a2) an optical detector, preferably a photodiode, that are maintained in contact with the ear lobe or hand web, preferably by a simple spring pressure clip.

The microprocessor of the (1) waterproof sensor and monitor periodically energizes—normally about every 200 milliseconds—so as to store successive blood flow detections in a memory, determining that heart stoppage of the wearer may have occurred if, nominally, 100 of such successive recordings, over a nominal elapsed time period of twenty seconds, are all the same.

If a possible heart stoppage of the wearer is determined, the (1) waterproof sensor and monitor causes an optical signal to output from at least one, and more preferably two, optical signal transmitters, Each such optical signal transmitter is preferably a bright, but sub-millimeter scale, blue-green LED. The emitted light travels through water with acceptable attenuation line-of-sight to detection, hopefully, by at least one of a preferable plurality of inexpensive, but sensitive, (2) optical detectors as may be located both submerged and in air. Any of these detectors receiving the heart stoppage-detected signal from any (1) waterproof sensor and monitor as may be mounted upon any swimmer or child will ultimately cause (3) an alarm to visibly and audibly sound in air.

Although straightforward in both implementation and operation, there are sufficient design choices made, and subtleties in operation, within the system and method of the present invention that a reader may not be quite sure as to what, if anything, is truly remarkable. It is respectfully suggested that the following aspects of the present invention demand attention. The electronic microprocessor and memory on a silicon chip, the battery, and the solar cell are of a prior art integrated design recently, circa 2010, originating at the University of Michigan. To this basic structure the present invention adds an infrared optical blood flow sensor (as an input stage) and also an LED optical heart-stoppage-alarm-signal (as an output stage). All this addition is done while preserving (1) the microminiaturized, square millimeter, size and (2) picowatt (steady state) power consumption, of this U of M essential design and product advance that is ten times smaller to do ten times the data acquisition and computation at one tenth the energy budget as heretofore. The key (1) waterproof sensor and monitor component of the system of the present invention is thus arguably one thousand times better than one has gone heretofore.

Next, this (1) waterproof sensor and monitor component of the system of the present invention makes effective use of blue-green light to communicate necessary and useful information—the potential heart stoppage of the wearer—through water to a next component in line, and ultimately to the attention of a human outside agent. It is of course of no avail that the waterproof sensor and monitor component should be very sophisticated to detect biological function and problems if it cannot communicate its information, and situations detected, to the "outside world." It is respectfully suggested that the optical communications paths of the present invention perform this necessary communication well.

Finally, the entire (1) waterproof sensor and monitor component of the system of the present invention is waterproofed with a new, state-of-the-art circa 2010, process and product called "Shellback". By this new (circa 2010) process and product not only may the electronics be protected but—consider this—no interference nor excessive attenuation, is caused to any of the optical paths of (1) sunshine or artificial light to the solar cell, (2) infrared light as is transmitted from transmitter to receiver during the blood flow sensing, of (3) blue-green light as is used to communicate the potential heart stoppage condition. The "Shellback" coating is not only transparent, it is so to a broad range of light wavelengths.

Because of the advanced power management—wherein the principal energy consuming circuitry is on for but microseconds during each 200 millisecond interval, or but one-ten thousandth the time—and solar cell recharging of the battery—as may occur when a device of the present invention not in active use is stored under a bright lamp—the device of the present invention requires but low, or no maintenance, as well as being reliable. A complex societal and safety problem is thus not only addressed by the present invention, but is substantially and successfully so addressed.

1. A System For Monitoring the Vitality of a Person

Accordingly, in one of its aspects the present invention is embodied in a system for monitoring the vitality of a person. The preferred system includes (1) a waterproof sensor, mounted to a person, periodically sensing the person's heart activity to produce an electrical signal indicative thereof, (2) a waterproof monitor receiving the electrical signal of the sensor and transmitting an optical alarm signal when the person's heart activity is determined to be stopped, (3) an optical receiver of the transmitted optical alarm signal, and causing to be produced in air an alarm that can be sensed by a human. By this coaction at such times as the optical alarm signal is timely generated by the monitor, and the alarm timely produced by the optical receiver and alarm, and sensed by the human, the person whose heart activity is sensed to be stopped can prospectively be aided by the human.

The system waterproof sensor is preferably an optical sensor of blood flow within micro-capillaries of the person's body as indicative of the activity or inactivity of the person's heart. This optical sensor of blood flow is preferably mounted to the earlobe of a swimmer, or to the web of a child's hand.

The monitor preferably determines the monitored person's heart activity to be stopped from successive electrical signals received that are unchanging, and thus representative of a stopped, as opposed to a functioning, heart. This monitor so functioning preferably includes a microprocessor running microcode, and a memory in which the received electrical signals indicative of the monitored person's heart activity are stored. This microprocessor and memory are only activated but periodically, thus saving power. Namely, each time the microprocessor and the memory are periodically energized an electrical signal received from the sensor is both stored and compared to a preceding succession of electrical signals already stored, the optical alarm signal being transmitted if and when a predetermined number of stored electrical signals are determined to be the same, thus potentially meaning that the sensed person's heart activity has stopped.

More particularly, the microprocessor and the memory are preferably activated only but every 200 milliseconds. The optical alarm signal is preferably then transmitted if and when 100 stored electrical signals are sensed to be invariant, meaning that the sensed person's sensed heart activity has been unchanging for 20 seconds, and the sensed person's heart activity has stopped.

The preferred monitor of the system of the preferred system of the present invention preferably further includes a battery providing electrical power to the microprocessor and the memory, and a solar cell for recharging the battery from incident received light illumination.

The optical alarm signal produced by the monitor is most preferably blue-green light transmittable through water.

At least one alarm signal produced in air by the optical receiver and alarm produces is preferably an audio alarm At least the sensor and the monitor are preferably both rendered waterproof by virtue of being coated with a transparent polymer, which transparent polymer neither interferes with (1) any optical path for sensing of the person's heart activity by the sensor, or (2) transmitting of the optical alarm signal by the monitor.

2. A Method of Monitoring the Vitality of a Swimmer Who is at Times Submerged while Swimming In another of its aspects the present invention is embodied in a method of monitoring the vitality of a swimmer who is at times submerged while swimming. The method includes (1) sensing in and with a sensor blood flow in and of the swimmer as an indication of the swimmer's heart beat over time in order to produce a succession of electrical signals. (2) receiving, storing, and interpreting in a monitor the succession of electrical signals received from the sensor in order to transmit an optical alarm signal if and when this succession of signals indicates that blood flow in the swimmer is consistently the same, and that the swimmer's heart could have stopped, AND (3) receiving in an optical receiver any optical alarm signal transmitted from the monitor, and producing responsively thereto an alarm signal that can be sensed by a human. By this coaction upon such times as the optical sensing is accurate, and the optical alarm signal prudently and timely produced, and this optical alarm signal timely received by the optical receiver to produce the alarm signal that can be sensed the human, then the person whose heart activity is sensed to be stopped can prospectively be aided by this human.

The sensing is of blood flow preferably consists of optically sensing blood flow within the micro-capillaries of the swimmer's ear lobe as the indicated of the swimmer's heart beat. This optical sensing of blood flow is preferably waterproof, and can transpire entirely underwater.

The interpreting in the monitor so as to determine that the monitored person's heart activity to be stopped preferably transpires if, and when, successive electrical signals received from the sensor that are unchanging, and thus representative of a stopped, as opposed to a functioning, heart. This receiving, storing, and interpreting in the monitor more particularly preferably transpires as running microcode in a microprocessor, and periodically storing within a memory the received electrical signals indicative of the monitored person's heart activity, so as by interpretation of the stored signals to determine whether a most recent succession are all the same, thus potentially meaning that the sensed person's heart activity has stopped.

The running of microcode in the microprocessor, and the periodically storing within a memory, preferably transpire only but periodically, saving power. More particularly, the running of microcode in the microprocessor, and the periodically storing within a memory, preferably transpire only but every 200 milliseconds, while the producing of the optical alarm signal is only if and when 100 stored electrical signals are sensed to be invariant, meaning that the sensing of the person's blood flow as does indicate heart activity has been unchanging for 20 seconds, and the sensed person's heart has stopped.

The method most preferably further includes providing electrical power from a battery to the sensor, and recharging with a solar cell the battery from received ambient light illumination.

The optical alarm signal transmitted by the monitor is most preferably blue-green light transmittable through water.

Finally, the method still further preferably includes waterproofing at least the sensor and the monitor by coating both with a transparent polymer, which transparent polymer neither interferes with (1) any optical path for the sensing in and with a sensor blood flow in and of the swimmer, nor (2) any transmitting of the optical alarm signal from the monitor.

3. Summary

In accordance with the two major variants of the present invention, the preferred system of the present invention may be understood to be minimal in construction, and with a minimal—but highly useful—function. Namely, the present invention is not interested in determining the source, nor evolution, nor even the individual identification of humans undergoing problems with maintenance of their life's vitality. The present invention is simply and straightforwardly directed to timely notifying supervisory persons such as lifeguards and nurses of incipient problems in their midst, especially such as arise from (1) swimmers at risk of drowning, or from (2) infants potentially subject to unexplained crib death syndrome.

These and other aspects and attributes of the present invention will become increasingly clear upon reference to the following drawings and accompanying specification.

BRIEF DESCRIPTION OF THE DRAWINGS

FIG. 1B is a diagrammatic perspective pictorial view of a first embodiment, for use by children and by infants, of the waterproof optically-sensing fiberless-optically-communicating vitality monitoring and alarming system of the present invention.

FIG. 2A1 is a view of the prior art millimeter-scale, energy-harvesting sensor system developed circa 2010 at the University of Michigan, that is the core of one, vitality monitoring, component of the present invention, and FIG. 2A2 is a view, similar to the view of FIG. 2A1, of the prior art millimeter-scale, energy-harvesting sensor system developed circa 2010 at the University of Michigan now enhanced and expanded in the silicon-based circuitry in partial realization of the vitality monitoring function of the present invention

DESCRIPTION OF THE PREFERRED EMBODIMENT

Figure 1A:
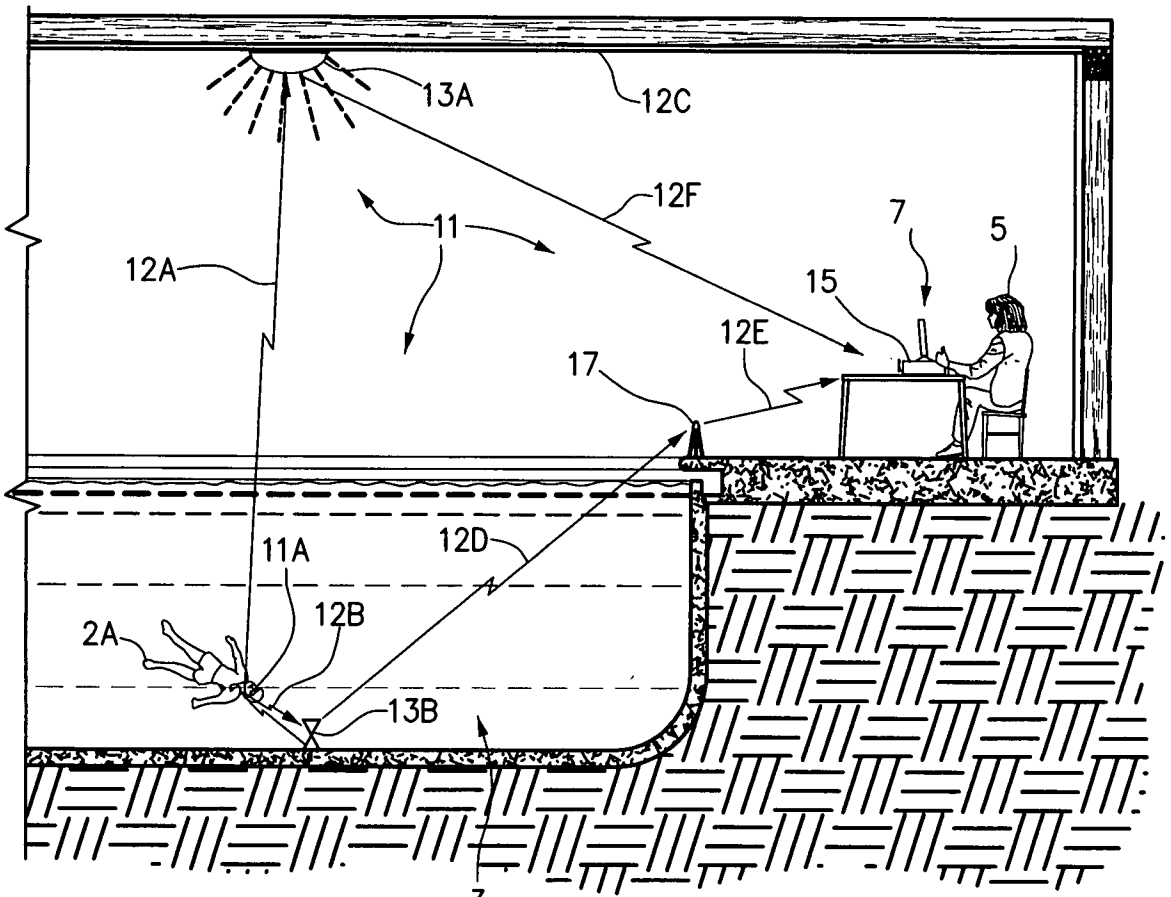
FIG. 1A is a diagrammatic perspective pictorial view of a first embodiment, for use by swimmers, of the waterproof optically-sensing fiberless-optically-communicating vitality monitoring and alarming system of the present invention.

The present invention realizes the continuous real-time monitoring of the vitality of swimmers in swimming pools, and infants in cribs in nurseries, so as to timely show and/or sound an alarm when the heart beat of the monitored person is sensed to have stopped so that lifesaving resuscitation is still possible.

1. Technical Goals of the Vitality Monitoring System of the Present Invention

The technical goals of the waterproof vitality monitoring and alarming system of the present invention are as follows.

The system should reliably sense some physiological indicator of human vitality. The system of the present invention senses the heart beat, as is detectable by blood flow various degrees of transparency of the ear lobe, or of the web of the hand, due to variations of blood flow in the micro-capillaries of these bodily regions. Morever, if the blood flow is sensed only every 200 milliseconds—which could be at the same phase to each successive heartbeat only at an impossibly high pulse rate of 300 beats per minute—then a reliable determination as to whether the heart is beating or not can be made over an interval as short as 20 seconds and shorter (i.e., some 100 sensed events). This interval is drastically shorter than the two minute interval within which irreversible damage can occur due resultantly from heart stoppage due to drowning, or SIDS. A heart stoppage alert timely generated at 20 seconds, or even less, thus potentially permits timely resuscitation of the person whose heart has stopped.

The state of the vitality indication sensed should be, and is in the system of the present invention, effectively and reliably communicated from a swimmer (or drowning victim) underwater through the water to, eventually, a surface platform, where an alarm is sounded upon the detection of an untoward condition.

Size and weight system components should be suitably small, especially such components as are mounted to the swimmer. Power consumption should likewise be suitable for system components, especially such components as (1) are mounted to the swimmer, or (2) must be battery powered.

All system components should support adequate communication speeds to the task at hand.

Finally, both and system components and system operation should be robust, with solid system operation under real world conditions and variables.

2. Considerations in Selection of a Vitality Sensor

The vitality sensor of the present invention energizes for a few microseconds preferably but every 200 milliseconds in order to sense transmission variations in an infrared light path through the micro-capillaries of either a wearer's ear lobe, or the web of either hand. Blood flow in the micro-capillaries of these regions causes optical transmission to vary. Commercial products observing this micro-capillary blood flow to so measure heartbeat already exist, but not (1) so as to determine vitality, nor with the (2) power saving cycle control, nor (3) solar-recharged battery power, that are within the present invention.

It should be understood that the infrequent, 200 millisecond interval, blood flow sampling performed by the system of the present invention is manifestly unsuitable for an electrocardiogram or other diagnosis of the electrical waveform of the heart, and/or the pressure waveforms within the arteries and veins, but is suitable only for detecting vitality, and then only when multiple readings are compared over a time interval, Morever, if the blood flow is sensed only but every 200 milliseconds—which could theoretically be at the same phase relative to each successive heartbeat only at an impossibly high pulse rate of 300 beats per minute—then whether the heart is beating or not can be reliably determined over an interval as short as 20 seconds and shorter, and drastically sooner than the two minute irreversible damage for heart stoppage due to drowning, or SIDS. In simple terms, consecutive blood flow measurements taken every 200 milliseconds may sometimes be the same, and a blood flow sensor may, due primarily to shock or vibration or adjustment by the wearer/user, fail to give a good and valid blood flow indication for some seconds. But if one hundred (100) consecutive blood readings over 20 seconds are all the same then there is a problem. Either a sensor has been removed by its user, and left to sit active in the system (therein to alarm "no blood flow detected"), or, of consummate importance in the pool or nursery environment of the present invention, the heart of the wearer of the sensor has stopped for 20 seconds.

3. Considerations in Selection of an Underwater Communications Channel

Detection of a blood flow interruption/stoppage at the ear lobe, or at the web of the hand, or even within a closely-situated microprocessor, is of no use unless this untoward condition should be effectively communicated to a lifeguard or other monitoring human for (1) a swimmer, or for (2) a baby. In simple terms it is of no avail to detect that a monitored human subject is dying unless help can be timely summoned.

A radio transmitter, and a radio communications channel, was considered for communication of an alarm condition in the system of the present invention. However, at all but extreme low frequency radio, the attenuation of a radio signal in water is extremely high. At very low frequencies radio attenuation in water is possible, with ultra low frequency radio being used for communication between land and submarines underwater. However, by the laws of radiophysics, efficient antennas for these frequencies are hundreds, and thousands, of feet in size—scarcely suitable for a swimmer. Moreover, at ULF radio maximum communications bandwidth is limited, and power requirements are high.

Sound, or acoustic, communication was also considered for use in the system of the present invention. For acoustic single transducers the emitter can be considered omnidirectional. In an acoustical communication system, transmission loss is caused by energy spreading and sound absorption. The energy spreading loss depends only on the propagation distance. The absorption loss increases with range and frequency. These problems set the limit on the available communications bandwidth. In general power requirements are too high for man-wearable portable devices.

Finally, optical communication was considered for the alarm signal pathway in the system of the present invention, and was ultimately chosen. However, but for being subject to directing or dispersing elements (lenses, mirrors, etc.) a laser or focused light beam is mono-directional, and unsuitable for omnidirectional communication in water.

However, water does present an excellent "passband" to light, and light communication. Within the visible light spectrum, light absorption in water is minimal in the range 400-450 nanometers. Namely; light absorption in water increases towards the red and infrared part of the spectrum. Blue-green light realizes minimal absorption in water at a wavelength around 400-450 nm. Optical (light) communication by visible blue-green light in this frequency/wavelength range can also be omnidirectional, being that extremely sensitive, tuned, detectors can be used to detect even the weakest of light signals.

Moreover, a modulated LED light source is both inexpensive and omnidirectional, and can be obtained in the 400-450 nm, light output frequency range. The tuned photodetector transistors serving as detectors of this 400-450 nm, light are also sensitive, inexpensive, and reliable.

However, mere choice of an optical alarm communication both does not solve all design issues. The implement of modulation, the receiver design, necessary amplification and/or filtering, and signal analysis needs all be considered.

A choice of AM Optical Transmission for optical signal modulation offers a MHz-range frequency response. However, this driving method is not capable of fully-driving the LED at the highest frequencies.

FM modulation is sometimes preferred over AM modulation since it was viewed as being more resistant to fading and variations in the signal amplitude. It works fine even though the duty cycle of the pulses should be extremely short (4 ns at 100 kHz).

Existing digital modulation models include the IrDa and RONJA and BPSK modulation systems.

The IrDa (Infrared Data) modulation system has the advantage that highly optimized integrated circuits are readily available at low price. However, it has a speed of only 14.4 kbit/sec within a range of, most typically, about 2.7 m.

The RONJA modulation system has a 10 Mbps rate full duplex communication speed (which duplexed communication is, however, not required in the system of the present invention).

BPSK modulation (as on AVI aka Manchester) can use lens amplification, and works in turgid water.

System goals, and cost and durability considerations in system design and fabrication, led to a blue-green diode transmitter using the RONJA fast driver modulation scheme. The allowed rate (10 Mbps) is bigger than the system need (~1 Mbps). Easy implementation is via a simple inverter array. Fast Manchester modulation transpires with a simple XOR gate, as will be seen in the Figures. A blue-green high-intensity LED source serves as the optical transmitter. The omnidirectional signal light is eye safe even at closest range nonetheless to having reasonable light intensity. Switching speed for signal modulation is good, with high emission and fast charge of the LED's capacitance. Small packaging is available.

4. Receiver Design and Build Requirements

The optical, blue-green light, alarm signal produced in and by an LED under the modulation (power) control of a microprocessor must be received in an optical receiver, The preferred optical receiver of the system of the present invention preferably uses a silicon photodiode for the visible spectral applications, specifically around 450 nm. light wavelength. Such a photodiode has a fast rise and fall time suitable for the RONJA dsPIC communications protocol. The receiver should be, and is, fast, sophisticated and sensitive, with good (optical) noise immunity. It should be supportive of the possibility of implementation in single-chip, that is: amplification, filtering, and demodulation all transpire in a single chip.

The receiver design of the system of the present invention requires PCB design and devices selection. A silicon Photodiode for the Visible Spectral Range type BPW 21, and the dsPIC communications protocol, are preferred. The receiver build requires the build of the PCB, and the soldering of the S.D. Devices.

5. Transmitter Design and Build Requirements

Figures 4A, 4B:
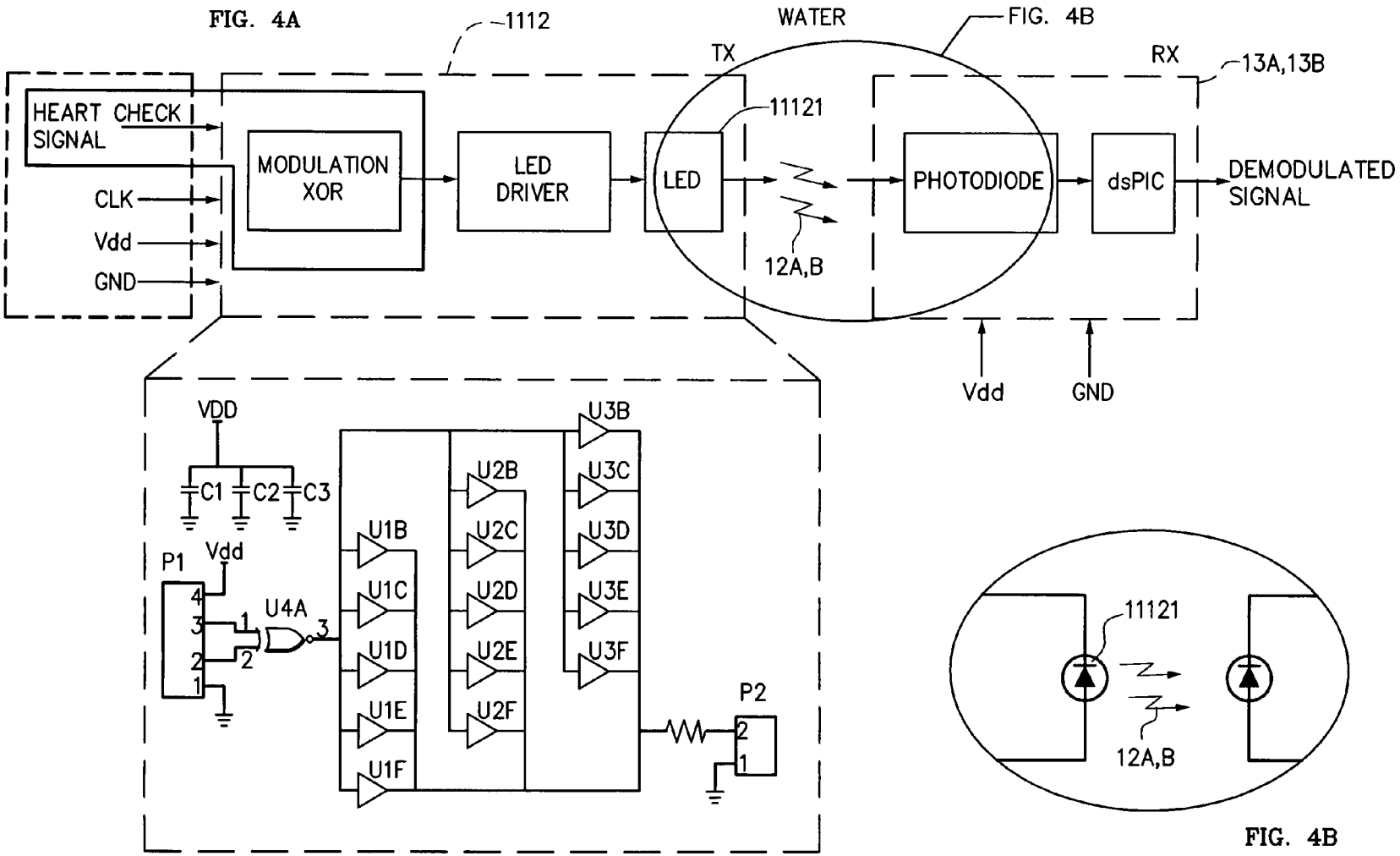
FIG. 4A is an electrical schematic diagram of (1) the LED OUTPUT sub-circuit of the vitality sensor component of the present invention previously seen in the schematic diagram of FIG. 3, and (2) a complimentary receiver circuit of the present invention previously seen diagrammatically in FIG. 1, where
FIG. 4B is a simplified electrical schematic diagram of less detail than is FIG. 4A so as to focus on the extreme simplicity of each of the LED output, the light transmission through water, and the phototransistor receiver circuit of the vitality sensor system of the present invention previously seen in FIG. 1A.

The optical transmitter design requires PCB design and selection of devices. A Z-Power LED Series X10190, a Hex Inverter MC74Ho4ADR2 and an XOR Gate MC74LVX86, as are shown in the schematic of FIG. 4A are preferred.

The transmitter build also requires a build of a PCB, and S.D. Devices soldering 6. The Preferred Embodiments of the System of the Present Invention 6.1 The Overall System of the Present Invention A diagrammatic perspective pictorial view of a first embodiment, for use by swimmers, of a waterproof optically-sensing fiberless-optically-communicating vitality monitoring and alarming system 1A of the present invention is shown in FIG. 1A. Likewise, a diagrammatic perspective pictorial view of a second embodiment, for use by infants, of the waterproof optically-sensing fiberless-optically-communicating vitality monitoring and alarming system 1B of the present invention is shown in FIG. 1B.

In the system 1A of FIG. 1A one or more vitality sensor(s) 11A upon one, or both, ear lobes of a swimmer 2 (not part of the system of the present invention) emits a blue green light signal upon pathways 12A, or 12B, or both such pathways, when the heart of swimmer 2A within the water 3 of a swimming pool (neither of which is part of the system of the present invention) is sensed to have stopped. Optional unit 13B is an underwater receiver/transmitter—not normally miniaturized but preferably battery powered—that simply serves to amplify and repeat the signal 12B, sending it further onward as bright blue-green light signal 12D detectable by poolside detector 17. Alternatively, and/or concurrently and in parallel, a blue green light signal upon pathways 12B from the same source in vitality sensor(s) 11A (whereby the heart of swimmer 2A within the water 3 of a swimming pool is sensed to have stopped) may be sent to ceiling unit 13A. Ceiling unit 13A is again a receiver/transmitter—not normally miniaturized and preferably battery powered—that can again amplify and repeat the signal 12B, sending it further onward as bright blue-green light signal 12F detectable again by poolside detector 17 (pathway not shown), or directly by a suitable light detector connected to PC 7 (not necessarily part of the present invention: reference the alternative of the next sentence) attended by human 5. (Neither the PC 7 nor the human 5 are part of the system of the present invention.)

Either the poolside sensor 17, or the ceiling sensor 13A, or even the PC 5, may optionally display, and sound, a visual and audio alarm. It is thus clear that an alarm may be variously sounded (and/or shown) at various locations and in various, and variously-named, units, the principle being only that an audio alarm most normally, and preferably, be sounded in air. All the above-enumerated units so qualify.

The purposes of the PC 7, and a potentially involved human attendant-and/or-first-responder 5, is primarily for enhanced and expanded versions of the system of the present invention. For example, each unit sensor 11A (or pairs of sensors 11A) as are worn by each swimmer 2 may be uniquely serialized and identified, and, when this information is optionally transmitted along with the alarm signal 12B, the particular swimmer that is ostensibly in trouble can sometimes be identified with particularity. However, these niceties are not necessary for an adequately functioning system. Namely, when so many as but one single swimmer is in trouble—let alone that his or her heart should have stopped—the swimming pool is cleared, and all activities save rescue com to a halt. The present invention is concerned with saving human life.

The second embodiment of the waterproof optically-sensing fiberless-optically-communicating vitality monitoring and alarming system 1B of the present invention shown in FIG. 1B functions likewise. A vitality alarm signal is developed by sensor 11B that is now most preferably upon the web of the hand of an infant 2B within a bed within a room 4 (infant 2B and room 4 are not part of the system of the present invention). Sensing of a stopped heart is again reported via, most preferably, optical signal 12B to ceiling-mounted receiver and alarm 13C. Again, a computer 7 and an attendant care giver 5 (not part of the present invention) may be, or become, involved. Likewise, the alarm signal may be transformed and further communicated, by wire or wireless as is desired, to a further alarm 13D in another room.

The purpose of these variations in both the first, and the second, embodiments of the system of the present inventor is simply to sensitize the reader to understand that the system of the present invention will be seen to be both powerful and flexible, and capable of doing much, much, more than simply, and only, monitoring heartbeat. The system of the present invention is, in fact, but a rudimentary microminiaturized version of a wireless real-time biological sensor and reporting system, further and more comprehensive versions of which are both contemplated and within the scope, and the framework, of the present invention.

However, this kind of sweeping claim, and prognostication, is but mere puffer until, and unless, something(s) can be shown that lends credence to Applicant's present claim that his basic system is very powerful, and extensible, and expandable. This showing is immediately next made, when it is explained that the "core" of Applicant's present system is at least ten times (×10) more computationally powerful while being at least ten times (×1) smaller and consuming ten times (×1) less energy than such biological sensors as have gone before. In one measure, the waterproof optically-sensing fiberless-optically-communicating vitality monitoring and alarming system 1 of the present invention is roughly one thousand times more advanced than what has gone before.

6.2 The "Core" of the System of the Present Invention

The "core" of the system of the present invention is the prior art, millimeter-scale, energy-harvesting sensor system developed circa 2010 at the University of Michigan and shown in FIG. 2A1. Comparison in size is made to the U.S. penny coin. The sensor system may be observed to be microminiaturized.

A microprocessor 1111 is mounted between a topmost solar cell 112 and a bottom battery 113, each on a separate substrate and/or being a separate body. Attachment of each in the illustrated stack is normally be adhesive. Electrical connection is between parts 112, 1111, and 113 is typically by wires ball-bonded to pads on each substrate and body 112, 1111, and 113. Bump pads and other connections as are common in the interconnection of miniaturized electronic circuitry may alternatively be used, as may traces of conductive adhesive.

Figure 2B:
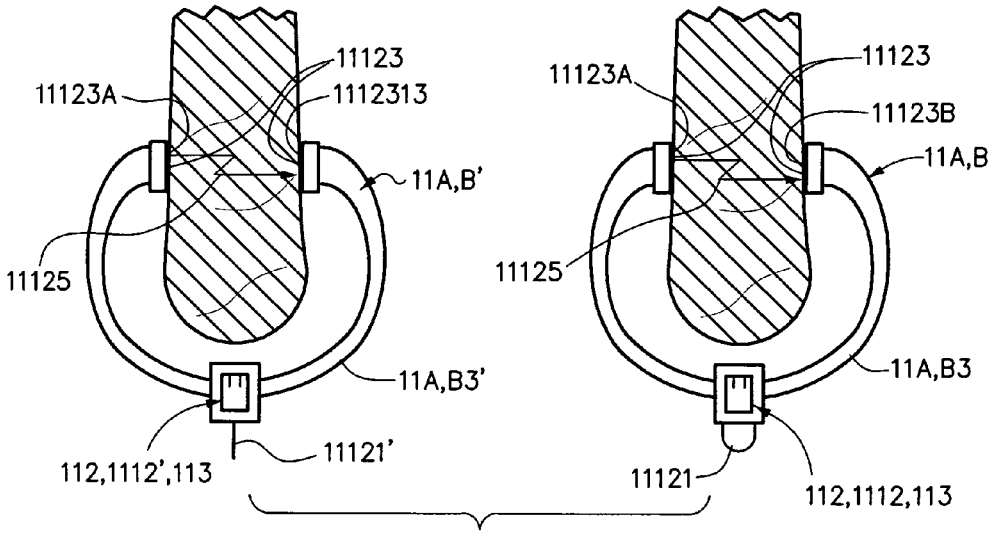
FIG. 2B is a diagrammatic perspective pictorial view of two variant embodiments of the vitality sensor component of the system of the present invention, each packaged for use to monitor a swimmer.
Figure 2C:
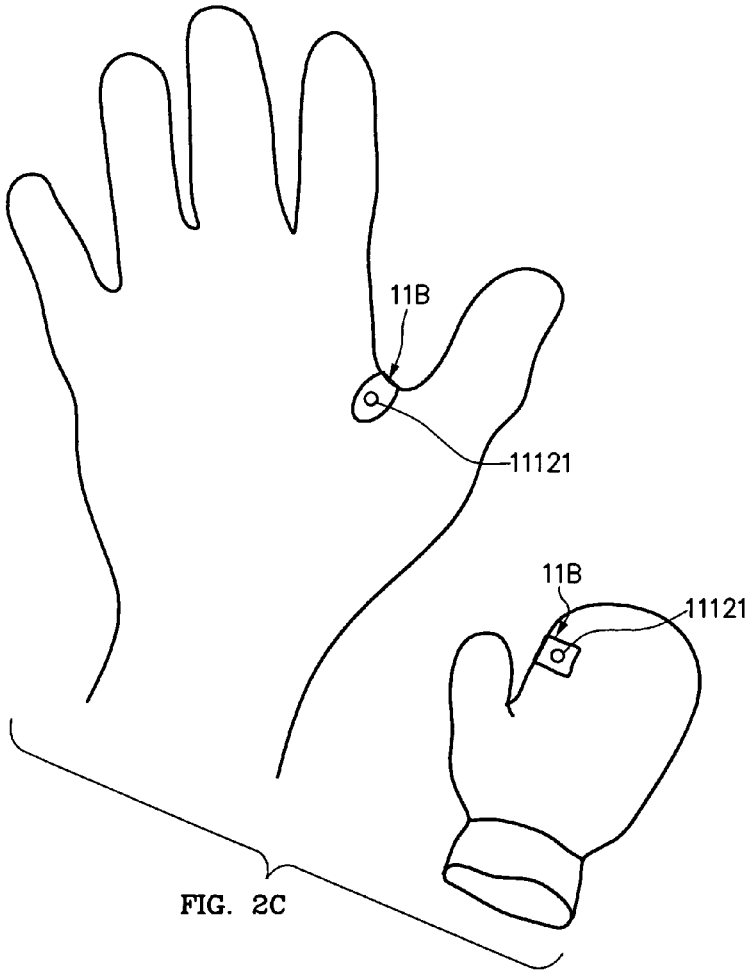
FIG. 2C is a diagrammatic perspective pictorial view of the first variant embodiment of the vitality sensor component of the system of the present invention in two different packagings each for use in the monitoring of children, and/or infants.
Figure 3:
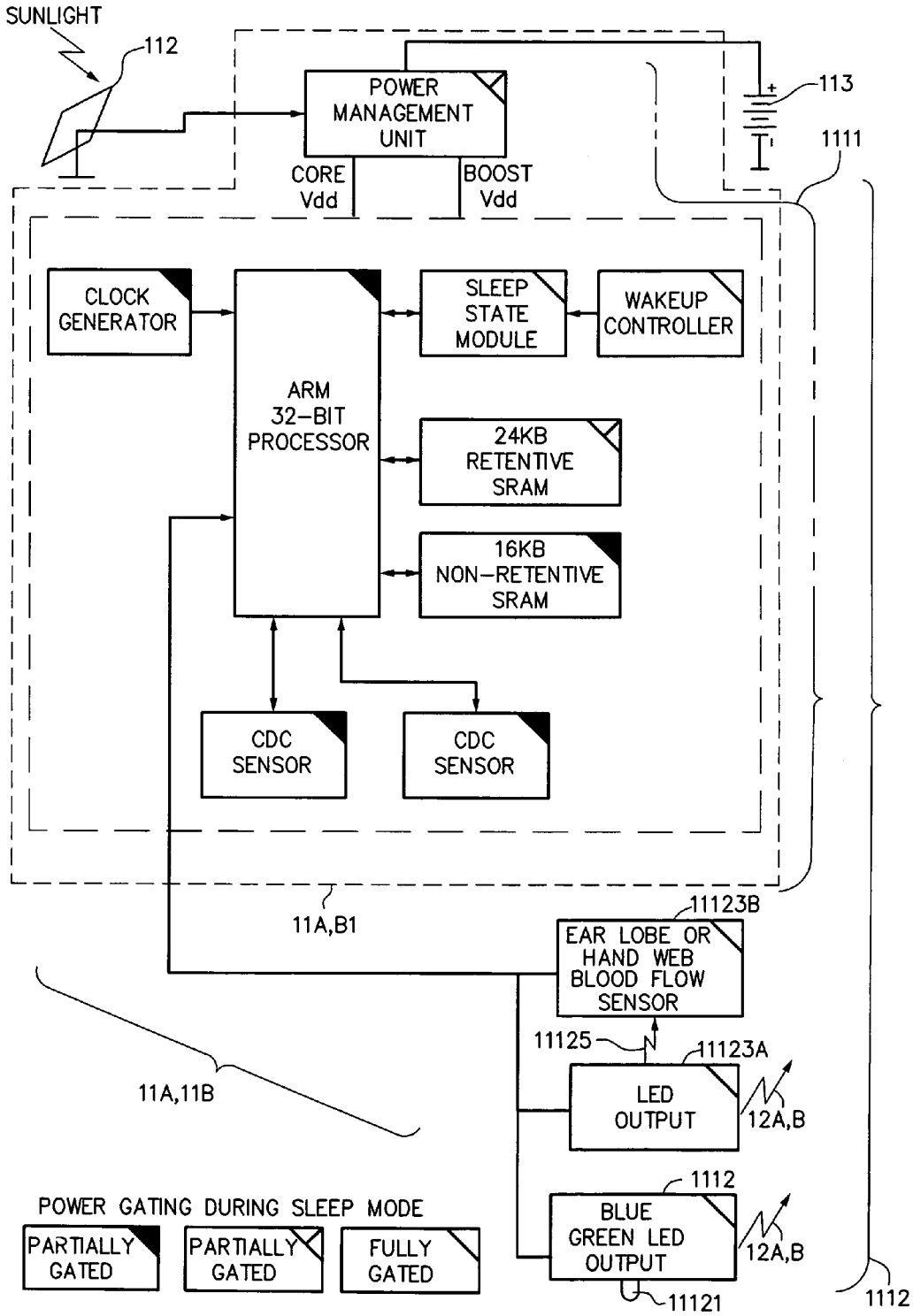
FIG. 3 is an electrical schematic diagram of the vitality sensor component shown in FIG. 2A2 as performs the sensing and monitoring of the present invention.

To the University of Michigan solar- and battery-powered microminiaturized microprocessor the present invention adds an optical heart rate detector 115 shown in FIGS. 3 and 4A, and the optical transmitter shown in FIGS. 3 and 4B. Before proceeding to the electrical circuits of these added elements (in accordance with the present invention), the nominal physical appearance of the complete integrated ensemble of the sensor 11A, and also an output LED 11121, may be observed in FIG. 2A2. It is clear that the solar cell 112 and the battery 113 can remain the same, or substantially so. (Although they can optionally be expanded).

A diagrammatic perspective pictorial view of two variant embodiments of the vitality sensor component 11A,B of the system 1 of the present invention—each packaged for use to monitor a swimmer—is shown in FIG. 2B. The two variant embodiments are extremely similar, essentially differing only in that the output LED 11121 of the most preferred embodiment shown at the right may be replaced by a millimeter size, and wavelength, radio antenna 11121' shown at in the variant to the left of FIG. 2B. Since, for reasons previously explained, an LED-produced blue-green light output signal is preferred for at least the use of the system of the present invention for swimmers, a radio-based alarm signal output variant of the vitality sensor 11A,B is not presently further developed within this specification. A practitioner of the communication arts will however recognize that micro-miniaturized and micro-powered radio chip sets are available (witness cellular telephony) and could be employed for the purposes of the present invention. If radio were so employed at least the challenges of the directional, line-of-sight, transmission of light signals might be mitigated. If radio were so employed then the vitality sensor 11A,B would look similar to the left variant of FIG. 2B.

Considering the preferred and primary variant of the vitality sensor 11A,B shown th the rightmost in FIG. 2B, the three miniature layers of the solar cell 112, the modified silicon circuitry 1112, and the battery 113 as were all seen in FIG. 2A2 are no visible as part of the larger package of the vitality sensor 11A,B. Now visible for the first time is the optical path and signal transmission 11125 through the ear lobe, of the web of the hand. Note that this transmission is directional, and from output infrared LED 11123A to infrared phototransistor receiver 11123B. Together this LED and phototransistor make for blood flow detector 11123.

The variants shown in FIG. 2C are of a different order, and are variants in packaging and not in electronic circuitry. Diagrammatic perspective pictorial views of the same first variant embodiment of the vitality sensor component of the system of the present invention is shown in tow different packagings, each primarily (but not necessarily) for use in air, and in monitoring of children, and/or infants as was illustrated in FIG. 1B. These many variants are at risk of leaving the reader confused, and the interpretation of the drawings intricate, and time consuming. The only thing that is really necessary for the reader to understand is that the system and method of the present invention are neither narrow nor hidebound for being (1) used in a particular scenario, (2) restricted to a particular packaging, nor even (3) implemented with particular electronic, and/or optical, components. Rather, the present invention should be interpreted broadly, and as a showing of how the very newest (circa 2010) miro-miniaturized and micro-powered electronic and optical components can versatilely realize new, and improved, biological monitoring and alarming functions.

An electrical schematic diagram of the vitality sensor component 11A, 11B shown in FIG. 2 as are extended and adapted for purposes of the present invention is shown in FIG. 3. All circuit elements save added elements 11A,B3, 11A,B5, and 11A,B7 are part of the prior art University of Michigan circuit. Element 11A,B3 is, as labeled, an EAR LOBE OF HAND WEB BLOOD FLOW SENSOR. Elements 11A,B5 and 11A,B7 are respectively, as labeled, FIRST BLUE-GREEN LED OUTPUT, and SECOND BLUE-GREEN LED OUTPUT An electrical schematic diagram of (1) the LED OUTPUT sub-circuits 11A,B5 and 11A,B7 of the vitality sensor 11A,B component of the present invention—previously seen in the schematic diagram of FIG. 3, are shown in FIG. 4, consisting of FIG. 4A and 4B. FIG. 4B is a simplified electrical schematic diagram of less detail than is FIG. 4A, FIG. 4B focusing in the simplicity of the LED output of the circuits 11A,B5 and 11A,B7 of FIG. 4A, the light transmission through water, and the extremely simple phototransistor receiver circuit 13C all previously seen in FIGS. 1A and 1B.

Figure 5:
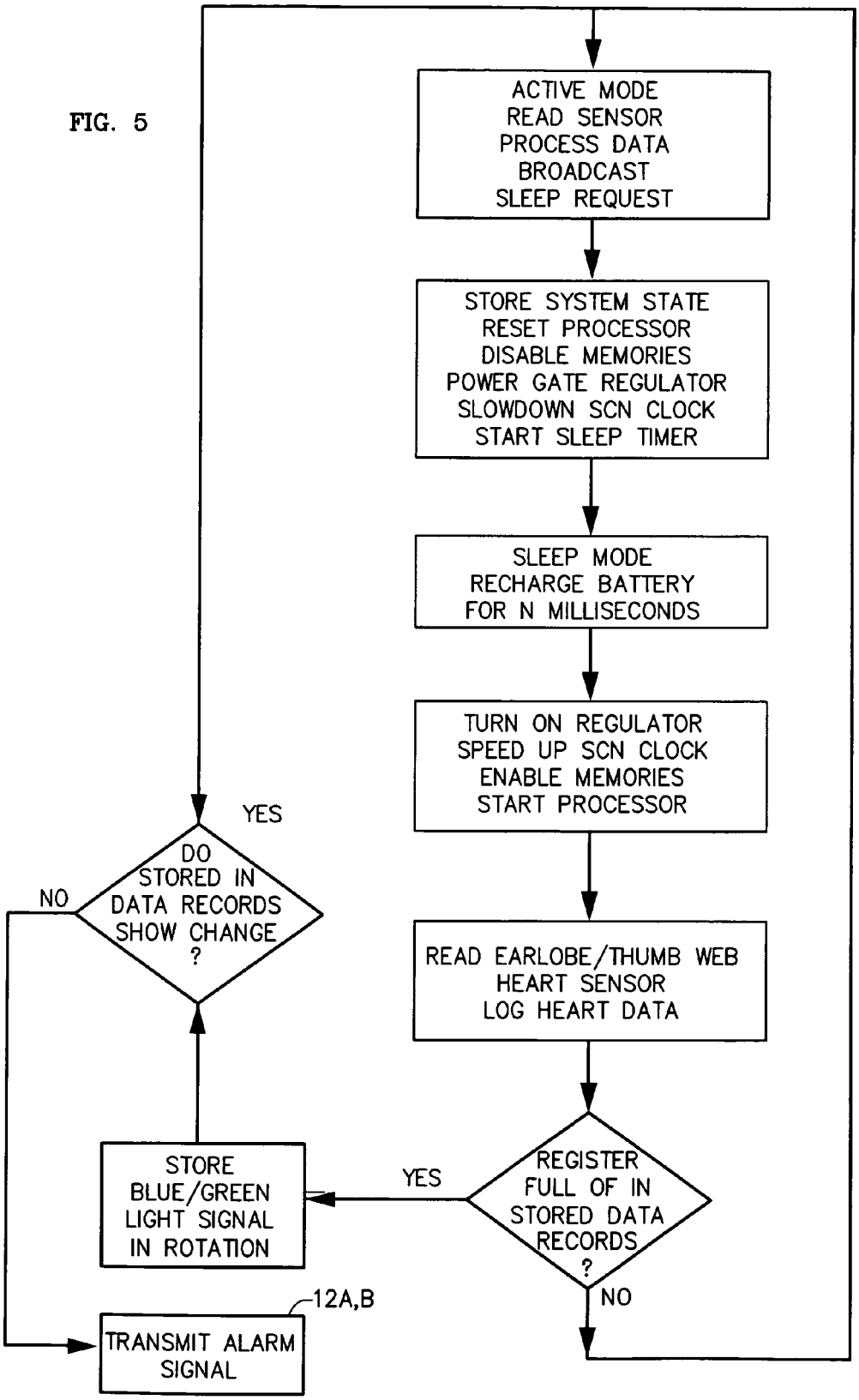
FIG. 5 is a flow chart of the microcode executed in the sensor, previously seen in the schematic diagram of FIG. 3, within the vitality monitoring and alarming system of the present invention previously seen in FIGS. 1A and 1B.

A flow chart of the sensor system of the present invention as was previously diagrammatically illustrated in FIGS. 1A and 1B is shown in FIG. 5. The flow-charted microcode is, quite naturally, executed by the ARM 32-BIT MICROPROCESSOR shown in the schematic diagram of FIG. 3 in realizing the purposes of the present invention.

At least the sensor and monitor 11A used underwater as shown in FIG. 1A, if not also other system components, is most preferably waterproofed with the "Shellback" process and product.

According to these variations, and still others within the skill of a practitioner of the electrical and optical design arts, the present invention should be considered in accordance with the following claims, only, and not solely on accordance with those embodiments within which the invention has been taught.

What is claimed is:

1. A system for monitoring the vitality of a person comprising:

a waterproof sensor configured to be mounted to a person, the sensor further configured to periodically sense the person's heart activity and produce an electrical signal indicative thereof, the waterproof sensor having unique identification information so it can be identified from other sensors worn by other persons;

a waterproof monitor comprising memory;

a microprocessor electrically coupled to the sensor and configured to receive the electrical signal indicative of the person's heart activity, the microprocessor further configured to store a succession of the electrical signals received from the sensor in the memory and determine if the person's heart is stopped based on the stored succession of electrical signals;

a location monitoring system for determining a location of the waterproof sensor;

an optical transmitter having a light source and coupled to the microprocessor, the microprocessor being further configured to produce an optical alarm signal using the light source when the microprocessor has determined the person's heart is stopped, wherein the optical alarm signal is modulated so that it the signal from the optical transmitter includes the unique identification information that identifies the waterproof sensor to identify the person wearing the waterproof sensor and includes location information to determine the location of the waterproof sensor;

an optical receiver comprising a detector configured to receive the optical alarm signal, the optical receiver configured to transform the alarm signal and communicate the transformed alarm signal; and a computer configured to receive the transformed alarm signal and determine the identity of the person to which the waterproof sensor is attached, determine the location of the waterproof sensor, and activate an alarm based on the transformed alarm signal.

2. The system according to claim 1, wherein the waterproof sensor comprises:

an optical sensor of blood flow within micro-capillaries of the person's body as indicative of the activity or inactivity of the person's heart.

3. The system according to claim 2, wherein the optical sensor is configured to be mounted to an earlobe of a swimmer.

4. The system according to claim 2, wherein the optical sensor is configured to be mounted to a web of a baby's hand.

5. The system according to claim 1, wherein the monitor determines the monitored person's heart activity to be stopped from successive electrical signals received that are unchanging, and thus representative of a stopped, as opposed to a functioning, heart.

6. The system according to claim 5, wherein the microprocessor and the memory are activated periodically; and wherein when the microprocessor and the memory are periodically activated the electrical signal received from the sensor is both stored and compared to a preceding succession of electrical signals already stored, the optical alarm signal being transmitted if and when a predetermined number of stored electrical signals are determined to be the same.

7. The system according to claim 6, wherein the microprocessor and the memory are periodically activated every 200 milliseconds; and wherein the optical alarm signal is transmitted if and when 100 stored electrical signals are sensed to be invariant, meaning that the sensed person's sensed heart activity has been unchanging for 20 seconds, and the sensed person's heart activity has stopped.

8. The system according to claim 6, wherein the monitor further comprises:

a battery providing electrical power to the microprocessor and the memory; and a solar cell for recharging the battery from incident received light illumination.

9. The system according to claim 1, wherein the optical alarm signal produced by the light source is blue-green light having a wavelength of between 400 and 450 nanometers.

10. The system according to claim 1, wherein the alarm produces an audio alarm.

11. The system according to claim 1, wherein the waterproof sensor and the waterproof monitor are integrated in a single package that is affixed to the ear lobe, or to the web of the hand.

12. The system according to claim 1, wherein the waterproof sensor and the waterproof monitor are in combination microminiaturized, and less than 1 square centimeter in area.

13. A method of monitoring the vitality of a swimmer who is at times submerged while swimming, the method comprising:

sensing with a waterproof sensor attached to a swimmer blood flow in the swimmer;

producing a succession of electrical signals indicative of the swimmer's heartbeat over time;

receiving, in a monitor attached to the swimmer, the succession of electrical signals from the waterproof sensor;

storing and interpreting, in the monitor, the succession of electrical signals;

determining a location of the waterproof sensor;

transmitting an optical alarm signal when the succession of signals indicates that the swimmer's heart has stopped, wherein the optical alarm signal is modulated and includes unique identification information that identifies the waterproof sensor to identify a person wearing the waterproof sensor with particularity and location information of the waterproof sensor;

receiving in an optical receiver any optical alarm signal transmitted from the monitor, and producing responsively thereto a transformed alarm signal; and receiving the transformed alarm signal, identifying with particularity the person wearing the waterproof sensor using the unique identification information, determining the location of the waterproof sensor using the location information, and activating an alarm based thereon.

14. The method according to claim 13, wherein the sensing is of blood flow comprises:

optically sensing blood flow within the micro-capillaries of the swimmer's ear lobe as an indication of the swimmer's heartbeat.

15. The method according to claim 13, wherein said interpreting in the monitor determines the monitored person's heart activity to be stopped from successive electrical signals received from the sensor that are unchanging, and thus representative of a stopped, as opposed to a functioning, heart.

16. The method according to claim 13, wherein the storing and interpreting in the monitor comprises:

running microcode in a microprocessor;

periodically storing within a memory the received electrical signals; and interpreting the stored electrical signals to determine whether a most recent succession are all the same indicating that potentially heart activity has stopped.

17. The method according to claim 16, wherein said running microcode in the microprocessor, and the periodically storing within a memory, occur periodically to save power.

18. The method according to claim 17, wherein the running of microcode in the microprocessor, and the periodically storing within a memory, occur every 200 milliseconds; and wherein the optical alarm signal is transmitted when 100 stored electrical signals are sensed to be invariant.

19. The method according to claim 13, further comprising: providing electrical power from a battery to the sensor; and recharging with a solar cell the battery from received ambient light illumination.

20. The method according to claim 13, wherein the optical alarm signal is blue-green light having a wavelength of between 400 and 450 nanometers.

21. The method according to claim 13, further comprising: waterproofing at least the sensor and the monitor are both so waterproof by coating with a transparent polymer, which transparent polymer neither interferes with any optical path for the sensing in and with a sensor blood flow in and of the swimmer, nor any transmitting of the optical alarm signal from the monitor.

22. The system of claim 1, wherein the alarm is not located in the same room as the person.

23. The system of claim 22, wherein the transformed alarm signal is communicated to a computer.

24. The system of claim 1, further comprising a global positioning system (GPS) that is configured to determine the location of the waterproof sensor.

25. The method of claim 13, wherein determining location of the sensor comprises using a global positioning system (GPS) to determine the waterproof sensor location.

* * * * *